US007909062B2

(12) United States Patent
Chen

(10) Patent No.: US 7,909,062 B2
(45) Date of Patent: Mar. 22, 2011

(54) TEMPERATURE CONTROL FAUCET WITH AN IMPROVED STRUCTURE

(76) Inventor: Qiyue Chen, Qinggang Town (CN)

( * ) Notice: Subject to any disclaimer, the term of this patent is extended or adjusted under 35 U.S.C. 154(b) by 920 days.

(21) Appl. No.: 11/797,550

(22) Filed: May 4, 2007

(65) Prior Publication Data

US 2008/0190500 A1 Aug. 14, 2008

(30) Foreign Application Priority Data

Feb. 9, 2007 (CN) ..... 2007 1 0037369

(51) Int. Cl.
*F16K 3/02* (2006.01)

(52) U.S. Cl. ..... 137/801; 251/352; 239/581.1

(58) Field of Classification Search ..... 137/615, 137/801; 251/352; 239/579, 581.1
See application file for complete search history.

(56) References Cited

U.S. PATENT DOCUMENTS

| | | | | |
|---|---|---|---|---|
| 2,783,035 | A * | 2/1957 | Rosenberg | 239/428.5 |
| 3,144,878 | A * | 8/1964 | Williams | 137/625.31 |
| 3,341,132 | A * | 9/1967 | Parkison | 239/443 |
| 4,181,987 | A * | 1/1980 | Kesselman | 4/678 |
| 4,821,765 | A * | 4/1989 | Iqbal et al. | 137/270 |
| 5,657,791 | A * | 8/1997 | Graber | 137/625.41 |
| 5,701,934 | A * | 12/1997 | Kuran et al. | 137/625.46 |
| 5,924,451 | A * | 7/1999 | Kuo | 137/801 |
| 6,321,788 | B1 * | 11/2001 | Egli | 137/615 |
| 6,959,729 | B2 * | 11/2005 | Graber | 137/625.31 |
| 7,114,515 | B2 * | 10/2006 | Sponheimer et al. | 137/454.2 |
| 7,314,062 | B2 * | 1/2008 | Chen | 137/625.41 |

FOREIGN PATENT DOCUMENTS

| | | |
|---|---|---|
| CN | 2178814 | 10/1994 |
| CN | 2554434 | 6/2003 |

* cited by examiner

*Primary Examiner* — John Fox
(74) *Attorney, Agent, or Firm* — Cheng Law Group, PLLC

(57) ABSTRACT

The present invention relates to a temperature control faucet with an improved structure in the valve technical field. The temperature control faucet addresses the defects existing in the prior art of inconvenient control and narrow range of use. The temperature control faucet of the invention comprises a valve body which has two inflow conduits and an outflow conduit, and a temperature control valve set in the valve body. The temperature control valve is arranged at the convergence of cold water and hot water of the inflow conduits within the cavity of the valve body. The temperature control valve is linked with a turn handle out of the valve body. A flow valve is provided at one end of the outflow conduit of the valve body to control the flow rate. The temperate and the flow rate could be separately controlled by the temperature control faucet with an improved structure of the invention. Therefore, the faucet is conveniently used, and has a small volume and a wide range of use.

18 Claims, 9 Drawing Sheets

TEMPERATURE CONTROL FAUCET WITH AN IMPROVED STRUCTURE

BACKGROUND OF THE INVENTION

1. Field of Invention

The present invention relates to a faucet to control the temperate and flow rate of water in the valve technical field.

2. Description of the Related Art

The conventional temperature control faucet could only control the water temperature, and could not adjust the flow rate, which brings inconvenience to the user. To this end, those skilled in the art have done long-term research to find a faucet to control the temperate and flow rate of water.

Taking an example, the Chinese patent CN93235282 discloses a dual control water saving faucet, comprising a valve body and a valve rod, wherein the middle and lower parts of the valve rod are located in the valve body, and a valve core is provided at the lower end of the valve rod, which is located within the lower valve bore. The temperature of the leaving water can be adjusted by controlling the valve core in the lower valve bore. A slope is set at the bottom surface of a nut having a cavity in a circumferential direction, on which a low-level groove, a middle-level step and a high-level step are arranged. A control rod matched with the slope is provided on the valve rod section in the cavity. The control rod is moved along the slope by turning a handwheel, so that a middle flow rate and a large flow rate are achieved. In this way, the flow rate is controlled. However, the amplitude of accommodation of the flow rate by said faucet is limited, the flow rate could not be linearly controlled, and the faucet could not be directly controlled to be turned on and off. Furthermore, it is difficult to control the faucet.

The Chinese patent application CN02227671.8 discloses a constant temperature and pressure faucet, comprising a valve body, a constant temperature and pressure valve core, a temperature control handwheel, a flow rate handwheel, and incoming and leaving water ports, wherein the constant temperature and pressure valve core is set in the valve body, the temperature control handwheel and the flow rate handwheel are respectively arranged on the ends of the valve body. Although the temperature and the flow rate could be independently controlled by this faucet, two handgrip handwheels need be provided on the valve body in such a technical scheme, and the flow rate and the temperature are separately controlled, causing a waste of water resource. On the other hand, the range of use of said faucet is limited, as two handgrip handwheels need be provided, the volume of the whole valve body is relatively large, it takes much space to connect the hot water pipe and the cold water pipe, and it is difficult for the faucet to be applied to narrow sites such as a wash basin and a kitchen sink.

SUMMARY OF THE INVENTION

In order to address the above problems, the present invention provides a temperature control faucet with an improved structure to independently control the temperature and the flow rate, which is conveniently operated, simply configured and widely applied.

Therefore, the present invention provides said temperature control faucet with an improved structure, comprising a valve body which has two inflow conduits and an outflow conduit and a temperature control valve set in the valve body, characterized in that, the temperature control valve is arranged at the convergence of cold water and hot water of the inflow conduits within the cavity of the valve body, the temperature control valve is linked with a turn handle out of the valve body, and a flow valve is provided at one end of the outflow conduit of the valve body to control the flow rate.

The temperature control valve could be used to control the ratio of the cold water and the hot water, in which the leaving water temperature could be adjusted by turning the turn handle. Due to the fact that the flow valve is set at the end of the outflow conduit, after the water temperature is adjusted, the flow valve is turned on to discharge water, and the flow valve is used to accomplish adjusting the flow rate. That is to say, the water could be directly used upon the flow valve being turned on, saving the water resource to some extent. The faucet is provided with a single turn handle and has a small volume. Moreover, the valve body has no special requirement for the positions of the hot and cold water pipes. Therefore, the faucet of the invention could be mounted within a narrow space and meet the installation requirements for different sites, thereby widening the range of use thereof.

In the temperature control faucet with an improved structure of the invention, the flow valve has a valve seat fixedly connected with one end of the outflow conduit. A ceramic core and a valve rod are mounted within the valve seat in turn. A stationary ceramic sheet of the ceramic core is fixedly connected with the valve seat, and a movable ceramic sheet of the ceramic core is fixedly connected with the valve rod. The valve rod is fixedly connected with a rotation mechanism which can rotate relative to the valve seat. A water passing hole is provided at the center of the valve rod. A stopper is arranged within the valve seat for limiting the maximum rotation angle of the valve rod to 90 degrees.

A stationary ceramic sheet and a movable ceramic sheet are superposed to form a ceramic core water passing holes are provided on the stationary ceramic sheet and the movable ceramic sheet, and the movable ceramic sheet could be driven to turn by the valve rod when the valve rod is turned, so that the water passing holes of the stationary ceramic sheet and the movable ceramic sheet could be communicated or disconnected, thereby the faucet could be turned on or off correspondingly. At the same time, the flow rate could be adjusted. The stationary ceramic sheet of the ceramic core and the valve seat as well as the movable ceramic sheet and the valve rod could be connected in a number of ways. For example, projections are symmetrically arranged on the periphery of the stationary ceramic sheet, and a groove is set on the inner wall of the valve seat into which the projections are inserted; notches are set on the movable ceramic sheet, and convex bodies are provided on the front end of the valve rod which could be inserted into the notches. Furthermore, the stopper for limiting the maximum rotation angle of the valve rod to 90 degrees could be molded on the convex body, thereby achieving said limitation.

In the temperature control faucet with an improved structure of the invention, the rotation mechanism has a cylindrical body, on the inner wall of which a stop edge is set. A shoulder is provided at the inner end of the valve rod, which is blocked within the valve seat. The outer end of the valve rod is passed out of the valve seat, and fixedly connected with the stop edge on the body by threads.

Alternatively, in the temperature control faucet with an improved structure of the invention, the rotation mechanism has a cylindrical body, on the inner wall of which a stop edge is set. A shoulder is provided at the inner end of the valve rod, which is blocked within the valve seat. The outer end of the valve rod is fixedly connected with a stop cap through the stop edge. The stop cap is set at the outer side of the stop edge. The outer end of the valve seat is pressed against the inner side of the stop edge.

In order to fixedly connect the valve rod to the body, in the temperature control faucet with an improved structure of the invention, several ribs are axially arranged at the outer end of the valve rod which could be embedded into the inner wall of the stop edge. Threads are cut on the ends of the ribs which could be connected with the stop cap.

The ribs can be inserted into the inner wall of the stop edge of the body. The valve rod can be circumferentially fixed by the ribs so as not to rotate. The ends of the ribs are fixedly connected with the stop cap to axially position.

According to said two schemes, the body is fixedly connected with the valve rod, so that the valve rod is driven to turn when the body is turned, and the flow valve is controlled.

In the temperature control faucet with an improved structure of the invention, a further outlet inner core is provided in the body for bubbling. The outlet inner core is confined within the body by an outlet press cap which is connected with the body by threads. A seal ring is placed between the outlet press cap and a stop cap.

The outlet inner core is cylindrical with several water passing holes on the side wall thereof. Meshes are set on both ends of the outlet inner core. The outlet inner core is configured to make the leaving water bubble, thereby preventing water splashing.

In the temperature control faucet with an improved structure of the invention, an annular groove is provided on the stop edge, in which a 0-type seal ring is mounted. The outer end of the valve seat is pressed against the stop edge. A seal is formed between the body and the valve seat by the 0-type seal ring to prevent leakage.

In the temperature control faucet with an improved structure of the invention, an abrasion preventing ring is placed between the valve seat and the body. The valve seat could rotate relative to the body in use. If the valve seat and the body have a gap therebetween, they will shake; and if the valve seat contacts with the body, there will be an abrasion therebetween. Therefore, an abrasion preventing ring is provided to function as an abrasion preventing device and a support.

Furthermore, in the temperature control faucet with an improved structure of the invention, the rotation mechanism has a coupling head with a through hole. The valve rod has a shoulder at the inner end, which is blocked within the valve seat. The outer end of the valve rod is inserted into the coupling head and connected with the coupling head by threads. A rotation cap is covered on the coupling head. The rotation cap is connected with the coupling head by threads, so that the valve rod is fixedly connected with the rotation cap. In such a way, the valve rod is turned by turning the rotation cap, and the flow valve is controlled.

Also, in order to make the leaving water bubble, in the temperature control faucet with an improved structure of the invention, an outlet inner core is placed between the rotation cap and the coupling head for bubbling, and a seal ring is arranged between the rotation cap and the coupling head.

In the temperature control faucet with an improved structure of the invention, a thread cap is set in the valve seat, which is pressed against the stationary ceramic sheet of the ceramic core. A seal ring is provided between the thread cap and the stationary ceramic sheet.

The temperature control faucet with an improved structure of the invention provides the following advantages over the prior art.

Firstly, a flow valve and a temperature control valve are respectively provided, so that both the temperature and the flow rate can be adjusted, facilitating the user's operation. More particularly, the flow valve is arranged at the end of the outflow conduit, so that the flow rate and the outflow conduit are scientifically combined. In such a case, the water can be discharged and the flow rate of the leaving water can be adjusted. Therefore, the operation is largely facilitated and the structure of the temperature control faucet is simplified.

Secondly, a turn handle is provided for controlling the water temperature. A flow valve is set at the end of the outflow conduit, which is controlled by a body or rotation cap. In this way, the overall volume of the faucet is efficiently reduced, and the faucet has a simple structure for mounting at each site.

Thirdly, the faucet has good sealing and anti-leaking properties, feels smooth when rotated, and has a long use life.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE PREFERRED EMBODIMENTS

First Embodiment

Figure 1:
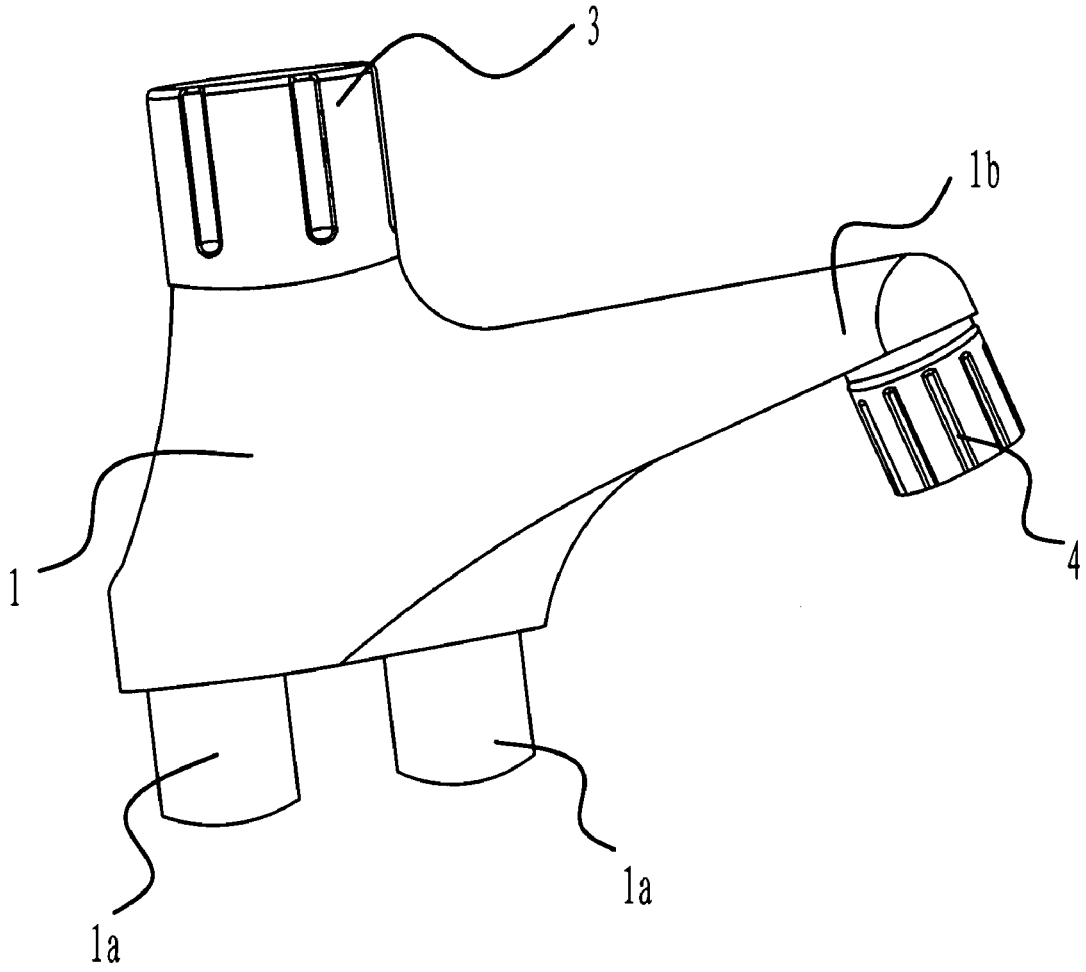
FIG. 1 is a stereogram of a first embodiment according to the invention.
Figure 2:
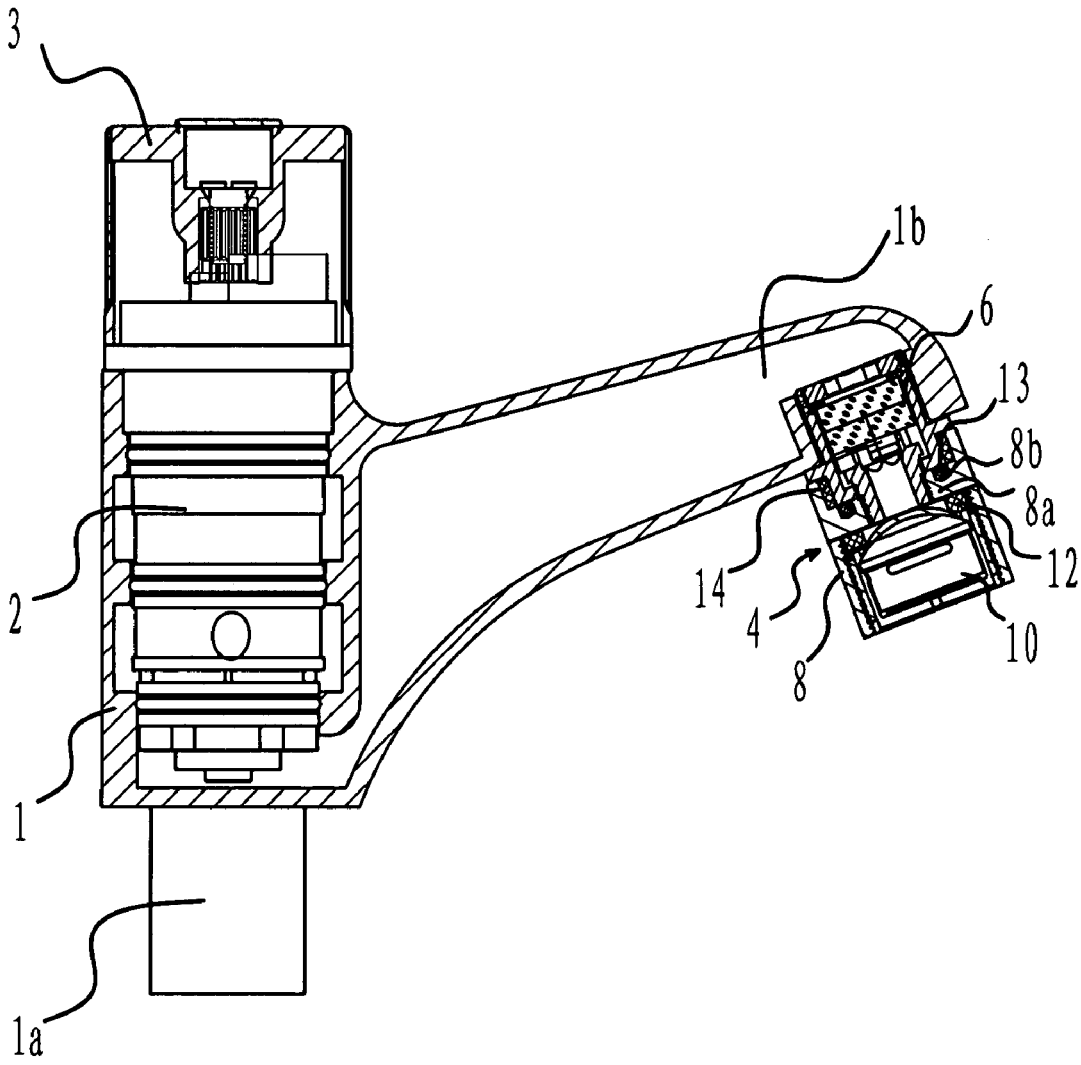
FIG. 2 is a section view of the first embodiment according to the invention.

As shown in FIGS. 1 and 2, a temperature control faucet with an improved structure of the invention includes a valve body 1, a temperature control valve 2 and a flow valve 4. The valve body 1 has two inflow conduits 1*a* and an outflow conduit 1*b*. The temperature control valve 2 is arranged at the convergence of cold water and hot water of the inflow conduits 1*a* within the valve body 1. The temperature valve 2 is linked with a turn handle 3 out of the valve body 1. The two inflow conduits 1*a* are respectively connected with a cold water pipe and a hot water pipe. A flow valve 4 is provided at one end of the outflow conduit 1*b* of the valve body 1 to control the flow rate. The leaving water temperature could be separately adjusted by turning the turn handle 3 of the temperature valve 2. The temperature is firstly adjusted and then the flow valve 4 is turned on while in use. Due to the fact that the flow valve 4 is set at the end of the outflow conduit 1*b*, water could be directly used upon the flow valve 4 being turned on, making the operation simple and saving the water resource. On the other hand, the faucet is provided with a single turn handle 3, so that it has a small volume and could be mounted within a narrow space, thereby widening the range of use thereof.

Figure 3:
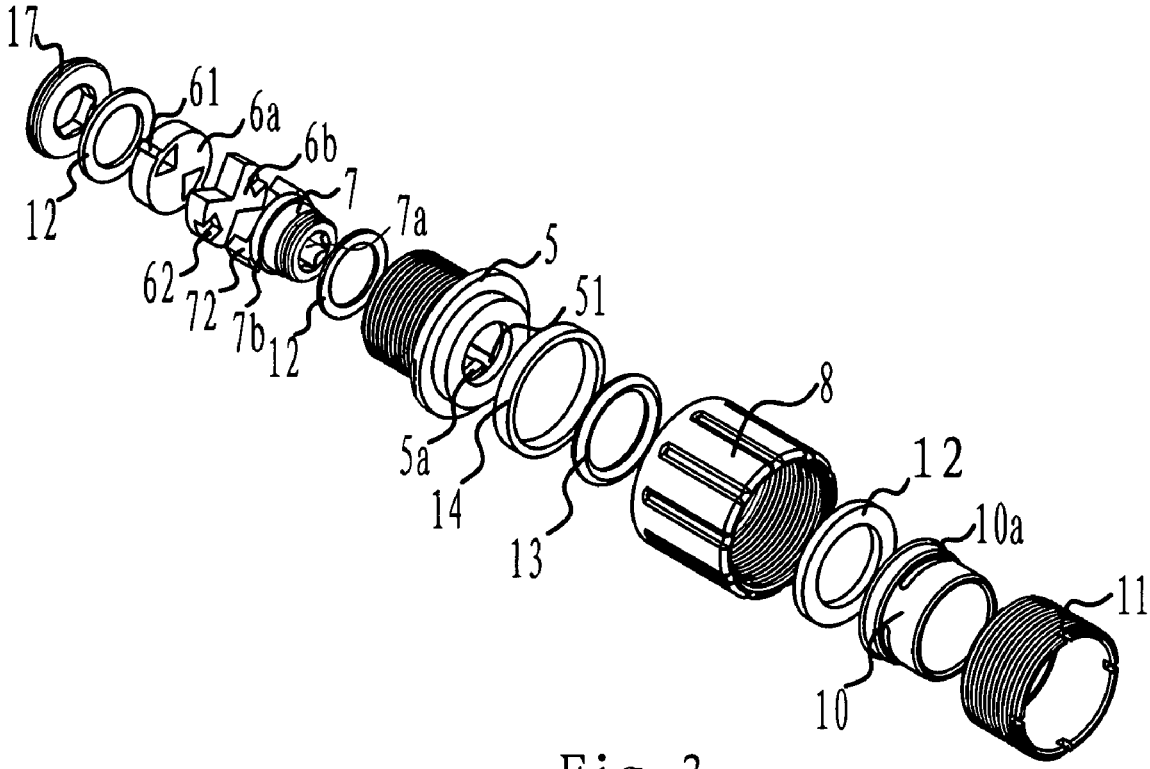
FIG. 3 is an exploded view of a flow valve in the first embodiment according to the invention.

In this embodiment, the flow valve 4 has a valve seat 5 fixedly connected with one end of the outflow conduit 1*b*, and a ceramic core 6 and a valve rod 7 are mounted within the valve seat 5 in turn, as shown in FIG. 2 and FIG. 3. A stationary ceramic sheet 6*a* of the ceramic core 6 is fixedly connected with the valve seat 5, and a movable ceramic sheet 6*b* of the ceramic core 6 is fixedly connected with the valve rod 7. The valve rod 7 is fixedly connected with a rotation mechanism which rotates relative to the valve seat 5. A water passing hole 7*a* is provided at the center of the valve rod 7. A stopper 5*a* is arranged within the valve seat 5 for limiting the maximum rotation angle of the valve rod 7 to 90 degrees.

The valve seat 5 is particularly connected with the outflow conduit 1*b* by threads. Two projections 61 are symmetrically arranged on the periphery of the stationary ceramic sheet 6*a*. A groove 51 is set on the inner wall of the valve seat 5. The projections 61 are inserted into the groove 51, so that the stationary ceramic sheet 6*a* is fixedly connected with the valve seat 5. A thread cap 17 is set in the valve seat 5, which is pressed against the stationary ceramic sheet 6*a* of the ceramic core 6. A seal ring 12 is provided between the thread cap 17 and the stationary ceramic sheet 6*a*. There are two notches 62 set on the movable ceramic sheet 6*b*. Two convex bodies 72 are provided on the front end of the valve rod 7 which could be inserted into the notches 62. When the convex bodies 72 are inserted into the notches 62, the movable ceramic sheet 6*b* is fixedly connected with the valve rod 7. The stationary ceramic sheet 6*a* and the movable ceramic sheet 6*b* are superposed to form the ceramic core 6. As water passing holes are provided on the stationary ceramic sheet 6*a* and the movable ceramic sheet 6*b*, the movable ceramic sheet 6*b* could be driven to turn by the valve rod 7 when the valve rod 7 is turned. In such a case, the stationary ceramic sheet 6*a* is not moved when the movable ceramic sheet 6*b* is turned, so that the water passing holes of the stationary ceramic sheet 6*a* and the movable ceramic sheet 6*b* could be communicated or disconnected, thereby the faucet could be turned on or off correspondingly, and the flow rate could be adjusted. The stopper 5*a* is used to block the convex bodies 72 on the valve rod 7, so as to restrict the rotation angle of the valve rod 7.

In this embodiment, the rotation mechanism includes a cylindrical body 8, on the inner wall of which a stop edge 8*a* is set. A shoulder 7*b* is provided at the inner end of the valve rod 7, which is blocked within the valve seat 5. The outer end of the valve rod 7 is passed out of the valve seat 5, and fixedly connected with the stop edge 8*a* on the body 8 by threads. During assembly, glues could be coated between the valve rod 7 and the stop edge 8*a*, and then the valve rod 7 is fixedly connected with the body 8 by threads.

An annular groove 8*b* is provided on the stop edge 8*a*, in which a 0-type seal ring 13 is mounted. The outer end of the valve seat 5 is pressed against the stop edge 8*a*. A seal is formed between the body 8 and the valve seat 5 by the 0-type seal ring 13 to prevent leakage. A further abrasion preventing ring 14 is placed between the valve seat 5 and the body 8. In such a case, the abrasion preventing ring 14 could function as an abrasion preventing device and a support when the valve seat 5 is rotated relative to the body 8.

In this embodiment, an outlet inner core 10 is provided in the body 8 for bubbling. The outlet inner core 10 is confined within the body 8 by an outlet press cap 11 which is connected with the body 8 by threads. A seal ring 12 is placed between the outlet press cap 11 and the stop edge 8*a*. The outlet inner core 10 is cylindrical with several water passing holes 10*a* on the side wall thereof. Meshes are set on both ends of the outlet inner core 10. The outlet inner core 10 is configured to make the flow bubble under action of the meshes and the water passing holes 10*a*, thereby preventing water splashing.

Second Embodiment

Figure 4:
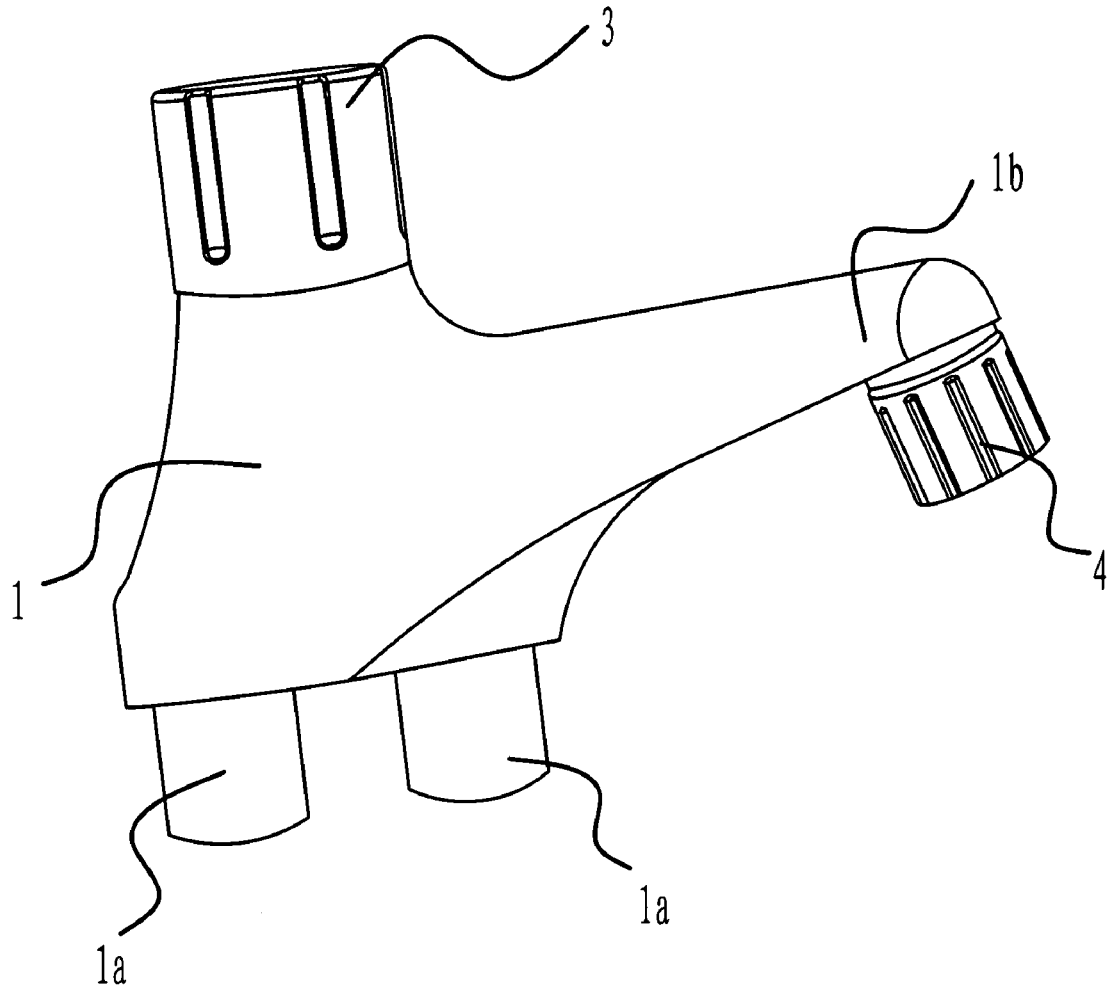
FIG. 4 is a stereogram view of a second embodiment according to the invention.
Figure 5:
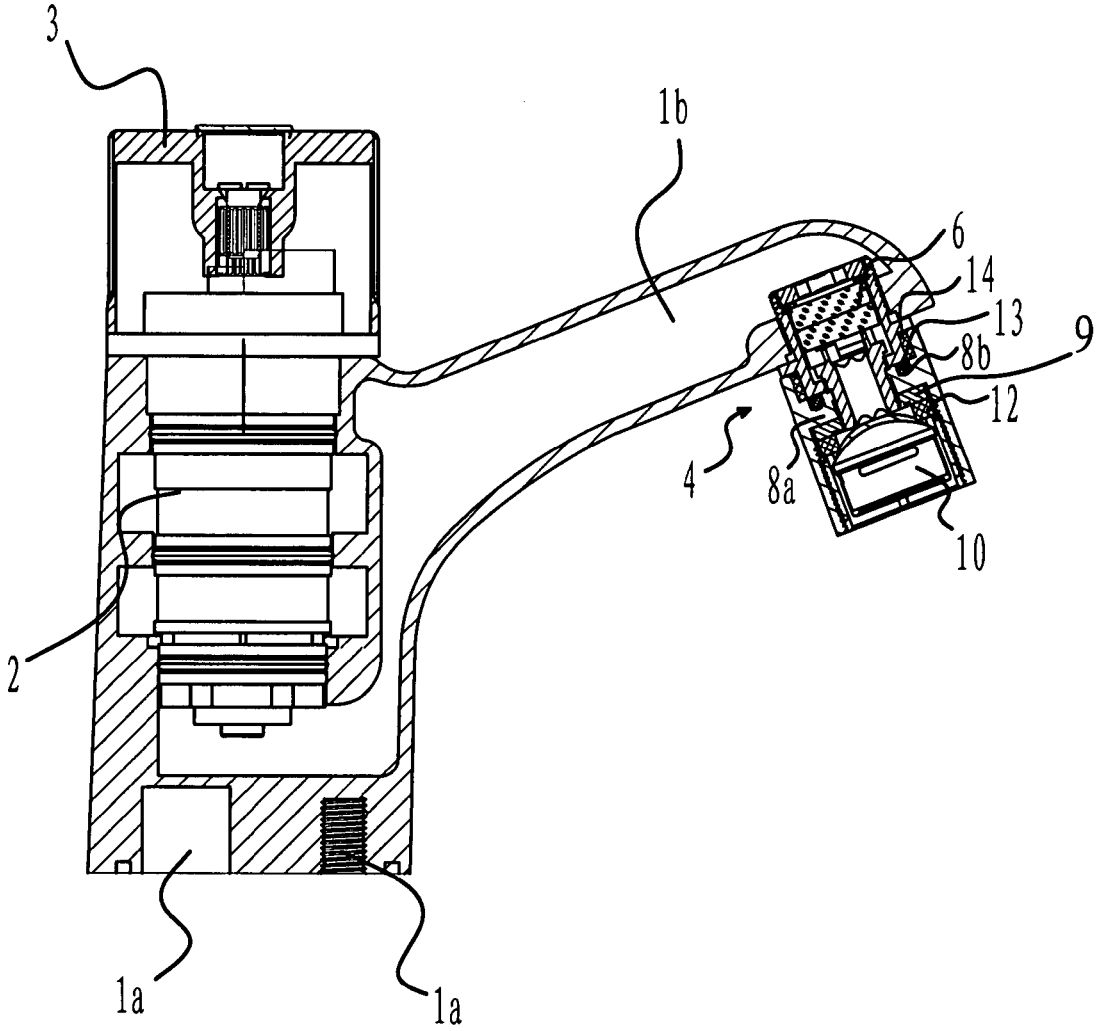
FIG. 5 is a section view of the second embodiment according to the invention.
Figure 6:
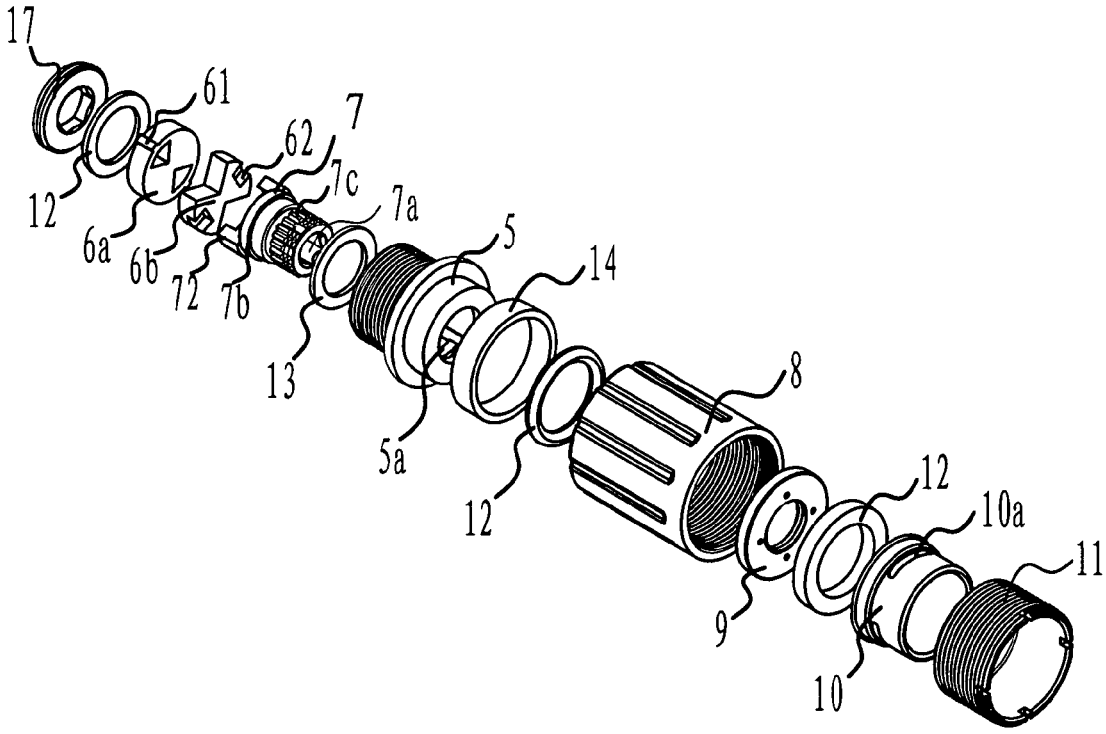
FIG. 6 is an exploded view of a flow valve in the second embodiment according to the invention.

In this embodiment, the rotation mechanism includes a cylindrical body 8, on the inner wall of which a stop edge 8*a* is set, as shown in FIGS. 4, 5 and 6. A shoulder 7*b* is provided at the inner end of the valve rod 7, which is blocked within the valve seat 5. The outer end of the valve rod 7 is fixedly connected with a stop cap 9 through the stop edge 8*a*. The stop cap 9 is set at the outer side of the stop edge 8*a*. The outer end of the valve seat 5 is pressed against the inner side of the stop edge 8*a*. Several ribs 7*c* are axially arranged at the outer end of the valve rod 7 which could be embedded into the inner wall of the stop edge 8*a*. Threads are cut on the ends of the ribs 7*c* which could be connected with the stop cap, so that the valve rod 7 is fixedly connected with the body 8. The ribs 7*c* can be inserted into the axial catching groove on the inner wall of the stop edge. The valve rod 7 can be circumferentially fixed by the ribs 7*c* so as not to rotate. The ends of the ribs 7*c* are fixedly connected with the stop cap 9 to axially position. Such a connection way facilitates improving the stability of connection. The description of this embodiment similar to that of the first embodiment will be omitted for simplicity.

Third Embodiment

Figure 7:
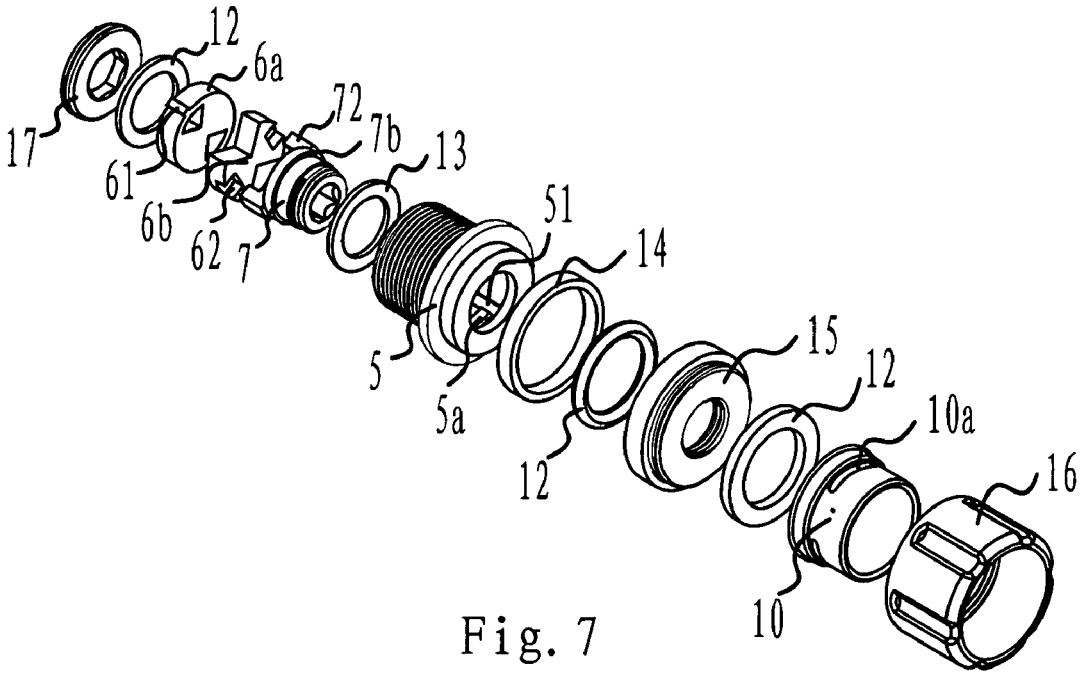
FIG. 7 is an exploded view of a flow valve in a third embodiment according to the invention.

In this embodiment, the rotation mechanism has a coupling head 15 with a through hole, as shown in FIG. 7. The valve rod 7 has a shoulder 7*b* at the inner end, which is blocked within the valve seat 5. The outer end of the valve rod 7 is inserted into the coupling head 15 and connected with the coupling head 15 by threads. A rotation cap 16 is covered on the coupling head 15. The rotation cap 16 is connected with the coupling head 15 by threads, so that the valve rod 7 is fixedly connected with the rotation cap 16. An outlet inner core 10 is provided between the rotation cap 16 and the coupling head 15 for bubbling. A seal ring 12 is placed between the rotation cap 16 and the coupling head 15. The description of this embodiment similar to that of the first embodiment will be omitted for simplicity.

Fourth Embodiment

Figure 8:
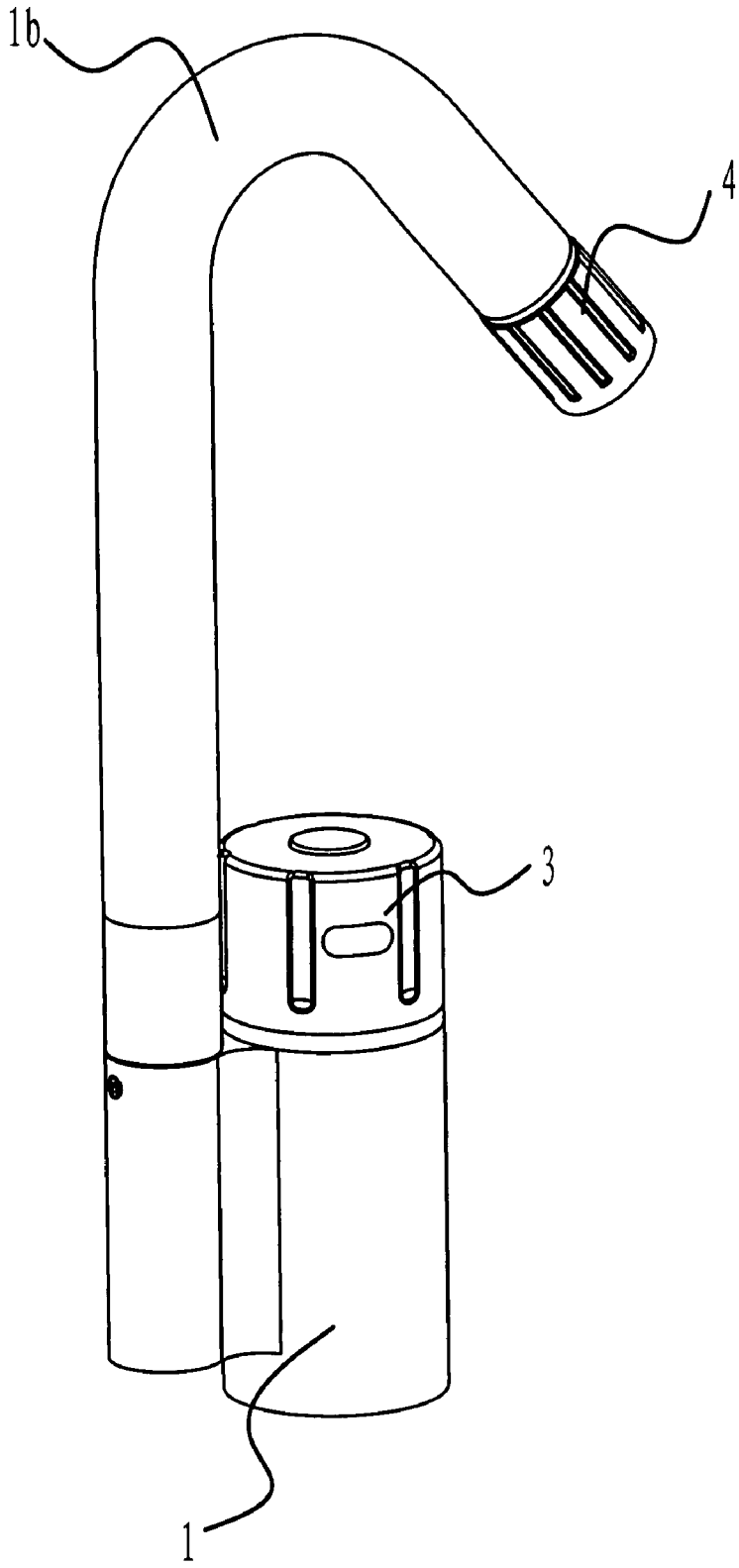
FIG. 8 is a stereogram view of a fourth embodiment according to the invention.
Figure 9:
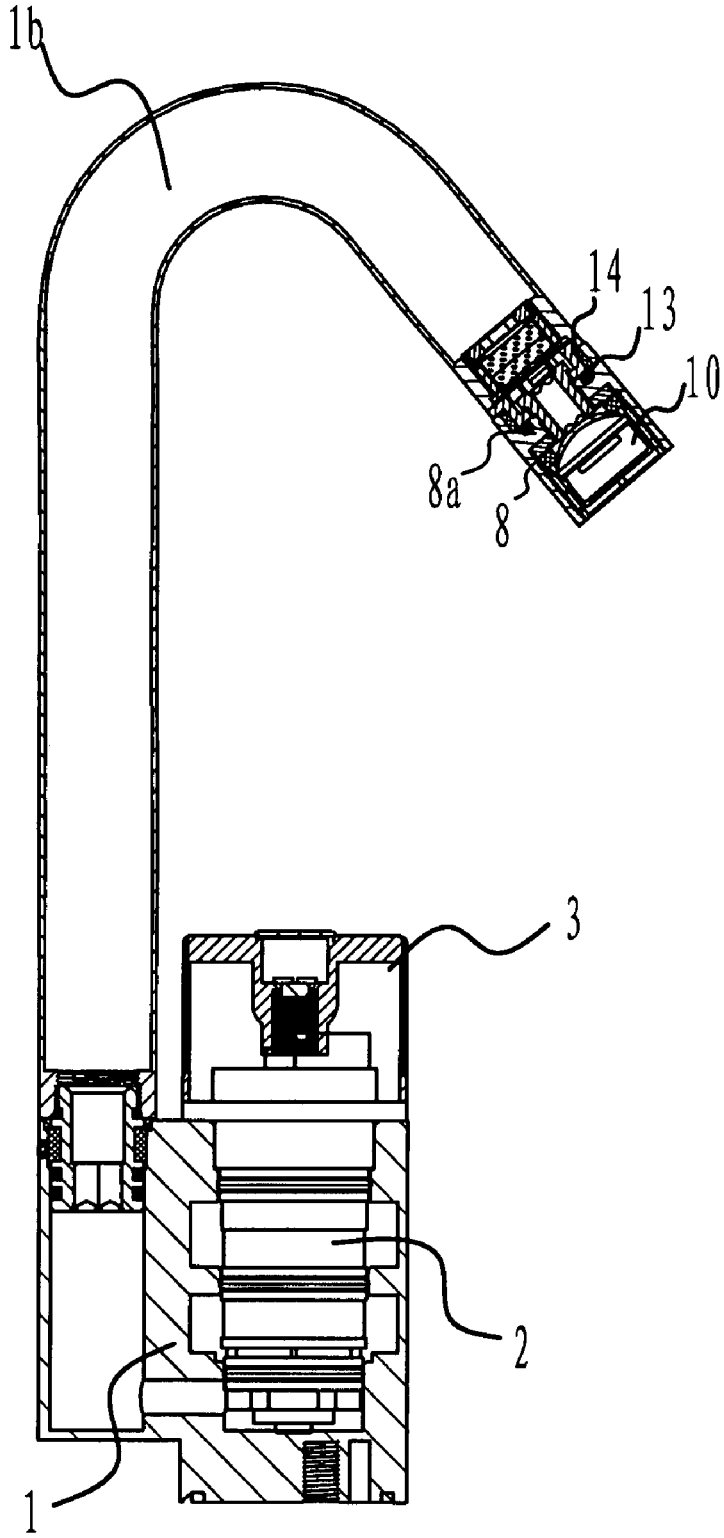
FIG. 9 is a section view of the fourth embodiment according to the invention.

As shown in FIGS. 8 and 9, the shape of the valve seat 5 could be configured according to the actual requirement. In this embodiment, the outflow conduit 1*b* could extend up to form a bent pipe. The description of this embodiment similar to that of the first embodiment will be omitted for simplicity.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

Although these terms are used herein, such as valve body 1, inflow conduit 1*a* and outflow conduit 1*b*, the other similar terms could also be used. These terms are merely used to describe and explain the essence of the invention more conveniently, and any limitation to said terms is regarded as departing from the spirit of the invention.

LIST OF REFERENCE NUMERALS

1 valve body
1*a* inflow conduit
1*b* outflow conduit
2 temperature control valve
3 turn handle
4 flow valve
5 valve seat
5*a* stopper
51 groove
6 ceramic core
6*a* stationary ceramic sheet
6*b* movable ceramic sheet
61 projection
62 notch
7 valve rod
7*a* water passing hole
7*b* shoulder
7*c* rib
72 convex body
8 body
8*a* stop edge
8*b* annular groove
9 stop cap
10 outlet inner core
10*a* water passing hole
11 outlet press cap
12 seal ring
13 0-type seal ring
14 abrasion preventing ring
15 coupling head
16 rotation cap
17 thread cap

What is claimed is:

1. A temperature control faucet with an improved structure, comprising a valve body which has two inflow conduits and an outflow conduit, and a temperature control valve set in the valve body, wherein the temperature control valve is arranged at the convergence of cold water and hot water of the inflow conduits within the cavity of the valve body, the temperature control valve is linked with a turn handle out of the valve body, and a flow valve is provided at one end of the outflow conduit of the valve body to control the flow rate, and wherein the flow valve has a valve seat fixedly connected with one end of the outflow conduit, a ceramic core and a valve rod are mounted within the valve seat in turn, a stationary ceramic sheet of the ceramic core is fixedly connected with the valve seat, a movable ceramic sheet of the ceramic core is fixedly connected with the valve rod, the valve rod is fixedly connected with a rotation mechanism which can rotate relative to the valve seat, a water passing hole is provided at the center of the valve rod, and a stopper is arranged within the valve seat for limiting the maximum rotation angle of the valve rod to 90 degrees.

2. The temperature control faucet with an improved structure as claimed in claim 1, wherein the rotation mechanism has a cylindrical body, on the inner wall of which a stop edge is set, a shoulder is provided at the inner end of the valve rod, which is blocked within the valve seat, and the outer end of the valve rod is passed out of the valve seat, and fixedly connected with the stop edge on the body by threads.

3. The temperature control faucet with an improved structure as claimed in claim 2, wherein a further outlet inner core is provided in the body for bubbling, the outlet inner core is confined within the body by an outlet press cap which is connected with the body by threads, and a seal ring is placed between the outlet press cap and the stop cap.

4. The temperature control faucet with an improved structure as claimed in claim 2, wherein an annular groove is provided on the stop edge, in which a 0-type seal ring is mounted, and the outer end of the valve seat is pressed against the stop edge; and an abrasion preventing ring is placed between the valve seat and the body.

5. The temperature control faucet with an improved structure as claimed in claim 2, wherein a thread cap is set in the valve seat, which is pressed against the stationary ceramic sheet of the ceramic core, and a seal ring is provided between the thread cap and the stationary ceramic sheet.

6. The temperature control faucet with an improved structure as claimed in claim 1, wherein the rotation mechanism has a cylindrical body, on the inner wall of which a stop edge is set, a shoulder is provided at the inner end of the valve rod, which is blocked within the valve seat, the outer end of the valve rod is fixedly connected with a stop cap through the stop edge, the stop cap is set at the outer side of the stop edge, and the outer end of the valve seat is pressed against the inner side of the stop edge.

7. The temperature control faucet with an improved structure as claimed in claim 6, wherein several ribs are axially arranged at the outer end of the valve rod which could be embedded into the inner wall of the stop edge, and threads are cut on the ends of the ribs which could be connected with the stop cap.

8. The temperature control faucet with an improved structure as claimed in claim 7, wherein a further outlet inner core is provided in the body for bubbling, the outlet inner core is confined within the body by an outlet press cap which is connected with the body by threads, and a seal ring is placed between the outlet press cap and the stop cap.

9. The temperature control faucet with an improved structure as claimed in claim 7, wherein an annular groove is provided on the stop edge, in which a 0-type seal ring is mounted, and the outer end of the valve seat is pressed against the stop edge; and an abrasion preventing ring is placed between the valve seat and the body.

10. The temperature control faucet with an improved structure as claimed in claim 7, wherein a thread cap is set in the valve seat, which is pressed against the stationary ceramic sheet of the ceramic core, and a seal ring is provided between the thread cap and the stationary ceramic sheet.

11. The temperature control faucet with an improved structure as claimed in claim 6, wherein a further outlet inner core is provided in the body for bubbling, the outlet inner core is confined within the body by an outlet press cap which is connected with the body by threads, and a seal ring is placed between the outlet press cap and the stop cap.

12. The temperature control faucet with an improved structure as claimed in claim 6, wherein an annular groove is provided on the stop edge, in which a 0-type seal ring is mounted, and the outer end of the valve seat is pressed against the stop edge; and an abrasion preventing ring is placed between the valve seat and the body.

13. The temperature control faucet with an improved structure as claimed in claim 6, wherein a thread cap is set in the valve seat, which is pressed against the stationary ceramic sheet of the ceramic core, and a seal ring is provided between the thread cap and the stationary ceramic sheet.

14. The temperature control faucet with an improved structure as claimed in claim 1, wherein the rotation mechanism has a coupling head with a through hole, the valve rod has a shoulder at the inner end, which is blocked within the valve seat, the outer end of the valve rod is inserted into the coupling head and connected with the coupling head by threads, a rotation cap is covered on the coupling head, the rotation cap is connected with the coupling head by threads, so that the valve rod is fixedly connected with the rotation cap.

15. The temperature control faucet with an improved structure as claimed in claim 14, wherein an outlet inner core is placed between the rotation cap and the coupling head for bubbling, and a seal ring is arranged between the rotation cap and the coupling head.

16. The temperature control faucet with an improved structure as claimed in claim 15, wherein a thread cap is set in the valve seat, which is pressed against the stationary ceramic sheet of the ceramic core, and a seal ring is provided between the thread cap and the stationary ceramic sheet.

17. The temperature control faucet with an improved structure as claimed in claim 14, wherein a thread cap is set in the valve seat, which is pressed against the stationary ceramic sheet of the ceramic core, and a seal ring is provided between the thread cap and the stationary ceramic sheet.

18. The temperature control faucet with an improved structure as claimed in claim 1, wherein a thread cap is set in the valve seat, which is pressed against the stationary ceramic sheet of the ceramic core, and a seal ring is provided between the thread cap and the stationary ceramic sheet.

* * * * *